US008965231B2

(12) United States Patent
Wakamatsu et al.

(10) Patent No.: US 8,965,231 B2
(45) Date of Patent: Feb. 24, 2015

(54) IMAGE FORMING APPARATUS

(71) Applicants: Mayu Wakamatsu, Nagoya (JP); Hiroshige Hiramatsu, Inuyama (JP)

(72) Inventors: Mayu Wakamatsu, Nagoya (JP); Hiroshige Hiramatsu, Inuyama (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 35 days.

(21) Appl. No.: 13/755,502

(22) Filed: Jan. 31, 2013

(65) Prior Publication Data

US 2013/0195495 A1 Aug. 1, 2013

(30) Foreign Application Priority Data

Jan. 31, 2012 (JP) ..... 2012-018895

(51) Int. Cl.

| | |
|---|---|
| ***G03G 21/10*** | (2006.01) |
| ***G03G 21/06*** | (2006.01) |
| ***G03G 15/01*** | (2006.01) |
| ***G03G 15/16*** | (2006.01) |

(52) U.S. Cl.

CPC ..... *G03G 21/06* (2013.01); *G03G 15/0189* (2013.01); *G03G 15/161* (2013.01)

USPC ..... 399/71; 399/354

(58) Field of Classification Search

USPC ..... 399/71, 343, 354

See application file for complete search history.

(56) References Cited

U.S. PATENT DOCUMENTS

| | | | | |
|---|---|---|---|---|
| 6,640,071 | B2 * | 10/2003 | Okada | 399/150 |
| 7,403,729 | B2 * | 7/2008 | Shida | 399/71 |
| 7,596,335 | B2 | 9/2009 | Fukami et al. | |
| 7,756,446 | B2 * | 7/2010 | Yoshikawa | 399/129 |
| 8,081,895 | B2 * | 12/2011 | Shigezaki et al. | 399/71 |
| 2007/0036578 | A1 | 2/2007 | Fukami et al. | |

FOREIGN PATENT DOCUMENTS

| | | |
|---|---|---|
| JP | 2002-049247 A | 2/2002 |
| JP | 2007-041348 A | 2/2007 |

* cited by examiner

*Primary Examiner* — Clayton E Laballe
*Assistant Examiner* — Leon W Rhodes, Jr.
(74) *Attorney, Agent, or Firm* — Banner & Witcoff, Ltd.

(57) ABSTRACT

An image forming apparatus including: an image carrier; a holding member that contacts with the image carrier and is configured to carry adhering substance received from the image carrier; a belt that contacts with the image carrier; a collection member that contacts with the belt and is configured to collect adhering substance adhered on the belt; and a control device configured to apply a bias to the collection member, detect an electric resistance of the collection member, and control the bias that is applied to the collection member based on the detected electric resistance of the collection member so that the electric resistance of the collection member is converged within a predetermined range, when a cleaning operation of collecting the adhering substance adhered on the holding member from the holding member to the collection member is not performed.

14 Claims, 6 Drawing Sheets

IMAGE FORMING APPARATUS

CROSS-REFERENCE TO RELATED APPLICATIONS

This application claims priority from Japanese Patent Application No. 2012-018895 filed on Jan. 31, 2012, the entire contents of which are incorporated herein by reference.

TECHNICAL FIELD

Aspects of the invention relate to an image forming apparatus of an electrophotographic type.

BACKGROUND

As an image forming apparatus of an electrophotographic type, a printer having a photosensitive member on which a developer image is formed has been known.

For example, a laser printer that has four photosensitive drums, four transfer rollers and a belt has been known (for example, refer to JP-A-2007-41348).

In the laser printer, the four photosensitive drums correspond to black, yellow, magenta and cyan, respectively. Also, the four transfer rollers are positioned just below the four photosensitive drums, respectively. The conveyance belt conveys a print sheet so that it sequentially passes between all the photosensitive drums and all the transfer rollers.

In the laser printer, while the print sheet is conveyed, an adhering substance (for example, paper dust, developer and the like) that is adhered on a surface of the conveyance belt is accommodated in a casing of a belt cleaning device via a first surface roller and a second surface roller by applying a bias to the first surface roller.

In the laser printer disclosed in JP-A-2007-41348, the bias is applied to the first surface roller. Therefore, when the laser printer is used for a long time, so-called energization deterioration is caused in which an electric resistance of the first surface roller is varied by current flowing to the first surface roller.

Here, when constant current control of controlling the current flowing to the first surface roller to be constant is performed, if the electric resistance of the first surface roller is varied, it is necessary to vary a voltage to be applied to the first surface roller so that the current flowing to the first surface roller becomes constant.

Therefore, in order to realize the constant current control to the first surface roller which is energization-deteriorated, if a power supply which allows variation in the voltage to be applied to the first surface roller and is capable of greatly varying the voltage is provided, the cost of the image forming apparatus increases.

Also, in order to suppress the cost of the image forming apparatus from increasing, if the belt cleaning device is replaced when the electric resistance of the first surface roller does not exceed a predetermined value, it is difficult to prolong a replacement period of the belt cleaning device, so that it is difficult to use the belt cleaning device for a long time.

SUMMARY

Accordingly, an object of the invention is to provide an image forming apparatus that can be used for a long time while suppressing the cost thereof from increasing.

According to an aspect of the invention, there is provided an image forming apparatus including: an image carrier; a holding member; a belt; a collection member; and a control device. An electrostatic latent image is configured to be formed on the image carrier. The holding member contacts with the image carrier and is configured to carry adhering substance received from the image carrier. The belt contacts with the image carrier. The collection member contacts with the belt and is configured to collect adhering substance adhered on the belt. The control device is configured to apply a bias to the collection member, detect an electric resistance of the collection member, and control the bias that is applied to the collection member based on the detected electric resistance of the collection member so that the electric resistance of the collection member is converged within a predetermined range, when a cleaning operation of collecting the adhering substance adhered on the holding member from the holding member to the collection member is not performed.

According to the above-described configuration, the control device controls the bias that is applied to the collection member so that the electric resistance of the collection member is converged within a predetermined range.

Therefore, it is possible to apply the bias to the collection member having the electric resistance adjusted within the predetermined range, so that it is possible to use the image forming apparatus while suppressing the increase in cost.

According to another aspect of the invention, there is provided an image forming apparatus including: an image carrier; a collection member; and a control device. An electrostatic latent image is configured to be formed on the image carrier. The collection member contacts with the image carrier and is configured to collect adhering substance adhered on the image carrier. The control device is configured to apply a bias to the collection member, detect an electric resistance of the collection member, and control the bias that is applied to the collection member based on the detected electric resistance of the collection member so that the electric resistance of the collection member is converged within a predetermined range, when a cleaning operation of collecting the adhering substance adhered on the image carrier to the collection member is not performed.

According to the above configuration, the control device controls the bias that is applied to the collection member so that the electric resistance of the collection member is converged within a predetermined range.

Therefore, it is possible to apply the bias to the collection member having the electric resistance adjusted within the predetermined range, so that it is possible to use the image forming apparatus while suppressing the increase in cost.

According to the above-described image forming apparatus, it is possible to adjust the electric resistance of the collection member, so that it is possible to use the image forming apparatus for a long time while suppressing the increase in cost thereof.

DETAILED DESCRIPTION

1. Overall Configuration of Printer

Figure 1:
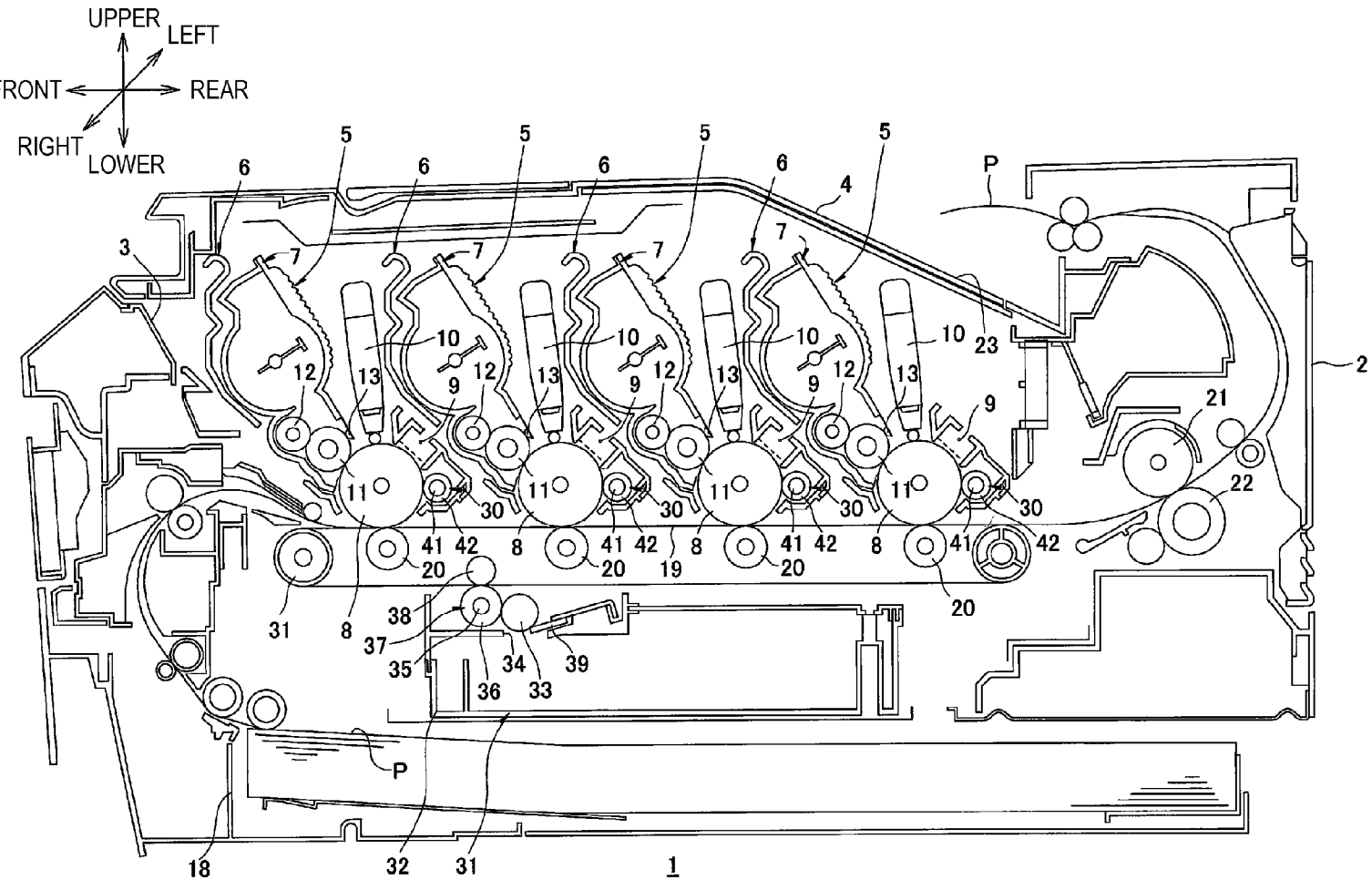
FIG. 1 is a sectional view of a printer according to an illustrative embodiment of the image forming apparatus of the invention.

As shown in FIG. 1, a printer 1 that is an example of the image forming apparatus is a direct tandem-type color printer of a horizontal storage type.

Meanwhile, in the following descriptions, the directions are described based on a state where the printer 1 is horizontally stored. That is, the left side of FIG. 1 is referred to as the front side and the right side of FIG. 1 is referred to as the rear side. Further, the left side and the right side are defined based on a state where the printer 1 is seen from the front. That is, the front side of FIG. 1 is the right side and the inner side of FIG. 1 is the left side.

The printer 1 has a body casing 2 having a substantially box shape. An upper end portion of the body casing 2 is provided with a top cover 4 opening and closing a body opening 3 so that it can be rotated about a rear end portion thereof serving as a support point. The printer 1 has four process cartridges 5.

All the process cartridges 5 are detachably provided in the body casing 2 and are arranged in parallel with each other at an interval in the front-rear direction. Also, each of the four processing cartridges 5 corresponds to one of four colors (black, yellow, magenta and cyan).

The process cartridge 5 has a drum cartridge 6 and a developing cartridge 7 that is detachably mounted to the drum cartridge 6.

The drum cartridge 6 has a photosensitive drum 8 that is an example of the image carrier.

The photosensitive drum 8 has a substantially cylindrical shape that is long in the left-right direction, and is rotatably provided to the drum cartridge 6.

Also, the drum cartridge 6 has a scorotron-type charger 9 that is arranged to face the photosensitive drum 8 at a rear-upper side of the photosensitive drum and an LED unit 10 that is arranged to face the photosensitive drum 8 at an upper side of the photosensitive drum.

The developing cartridge 7 has a developing roller 11.

The developing roller 11 extends in the left-right direction, is provided at a rear end portion of the developing cartridge 7 so that it is exposed from the rear side, and contacts with the photosensitive drum 8 from the front-upper side.

Also, the developing cartridge 7 has a supply roller 12 that supplies toner to the developing roller 11 and a layer thickness regulation blade 13 that regulates a thickness of the toner supplied to the developing roller 11. Also, the toner that is an example of the developer is accommodated in the developing cartridge 7 at the upper of the developing roller 11 and the supply roller 12.

The toner in the developing cartridge 7 is positively friction-charged between the supply roller 12 and the developing roller 11 and is carried on a surface of the developing roller 11 as a thin layer having a predetermined thickness by the layer thickness regulation blade 13.

In the meantime, a surface of the photosensitive drum 8 is uniformly charged by the scorotron-type charger 9 and is then exposed based on predetermined image data by the LED unit 10. Thereby, an electrostatic latent image based on the image data is formed on the surface of the photosensitive drum 8. The toner carried on the developing roller 11 is supplied to the electrostatic latent image on the photosensitive drum 8, so that a toner image (developer image) is formed on the surface of the photosensitive drum 8.

A sheet P that is an example of the transferred member is accommodated in a sheet feeding tray 18 that is provided at a bottom part of the body casing 2, and is conveyed to U-turn toward the rear-upper side by an variety of rollers, so that it is fed one by one between the photosensitive drums 8 and a conveyance belt 19, which is an example of the belt contacting with the photosensitive drums 8 from the lower sides thereof, and at a predetermined timing. Then, the sheet P is conveyed from the front side toward the rear side between all the photosensitive drums 8 and all the transfer rollers 20 by the conveyance belt 19 so that it contacts with all the photosensitive drums 8. At this time, the toner image is transferred to the sheet P. Meanwhile, in the following descriptions, an operation of transferring the toner image to the sheet P from the photosensitive drum 8 is referred to as a transfer operation.

Then, the sheet P is heated and pressurized when passing between a heating roller 21 and a pressing roller 22. At this time, the toner image is heat-fixed on the sheet P.

After that, the sheet P is conveyed to U-turn toward the front-upper side and is then discharged onto a sheet discharge tray 23 that is provided to the top cover 4.

2. Configuration of Cleaning of Photosensitive Drum and Conveyance Belt

In the body casing 2, drum cleaning rollers 30 that are examples of the four holding members and one belt cleaning unit 31 are provided.

(1) Configuration of Cleaning of Photosensitive Drum

The four drum cleaning rollers 30 are arranged to face the four photosensitive drums 8 at the rear sides thereof, respectively. Also, the drum cleaning roller 30 contacts with the corresponding photosensitive drum 8 from the rear side of the photosensitive drum. Also, the drum cleaning roller 30 has a drum cleaning roller shaft 41 and a drum cleaning roller body 42. The drum cleaning roller 30 can rotate about the drum cleaning roller shaft 41.

The drum cleaning roller shaft 41 is made of metal and has a substantially cylindrical shape extending in the left-right direction.

The drum cleaning roller body 42 is made of resin, has a substantially cylindrical shape extending in the left-right direction and covers the drum cleaning roller shaft 41 so that it exposes left and right end portions of the drum cleaning roller shaft 41.

(2) Configuration of Cleaning of Conveyance Belt

The belt cleaning unit 31 is arranged at the lower side of the conveyance belt 19 and at the upper side of the sheet feeding tray 18. The belt cleaning unit 31 has an accommodation housing 32, a belt cleaning roller 37 that is an example of the collection member, a collection roller 33 that is an example of the removal member and a scraping blade 39.

The accommodation housing 32 has a substantially box shape extending in the front-rear direction. An upper wall at a rear end of the accommodation housing 32 is formed with a collection port 34 that opens upwards.

The belt cleaning roller 37 is arranged at the front-upper side of the collection port 34. The belt cleaning roller 37 has a belt cleaning roller shaft 35 and a belt cleaning roller body 36.

The belt cleaning roller shaft 35 is made of metal and has a substantially cylindrical shape extending in the left-right direction. The belt cleaning roller shaft 35 is rotatably supported to the accommodation housing 32.

The belt cleaning roller body 36 is made of conductive resin and the like, has a substantially cylindrical shape extending in the left-right direction and covers the belt cleaning roller shaft 35 so that it exposes left and right end portions of the belt cleaning roller shaft 35.

The collection roller 33 is rotatably supported to the accommodation housing 32 in the collection port 34 so that it contacts with the belt cleaning roller 37 from the rear-lower side of the belt cleaning roller 37. The collection roller 33 is made of metal and has a substantially cylindrical shape extending in the left-right direction.

The scraping blade 39 is arranged at the rear-lower side of the collection roller 33. The scraping blade 39 has a substantially plate shape that is long in the left-right direction, is supported to the accommodation housing 32 at a rear end portion thereof, i.e., at a base end portion thereof and contacts with a circumferential surface of the collection roller 33 at a front end portion thereof, i.e., at a free end portion thereof.

Also, an opposing roller 38 is provided at the inside of the conveyance belt 19.

The opposing roller 38 is arranged to face the belt cleaning roller 37 at the upper side of the belt cleaning roller 37 with the lower part of the conveyance belt 19 being interposed therebetween. The opposing roller 38 is made of metal and has a substantially cylindrical shape extending in the left-right direction.

3. Electrical Configuration of Printer

Figure 2:
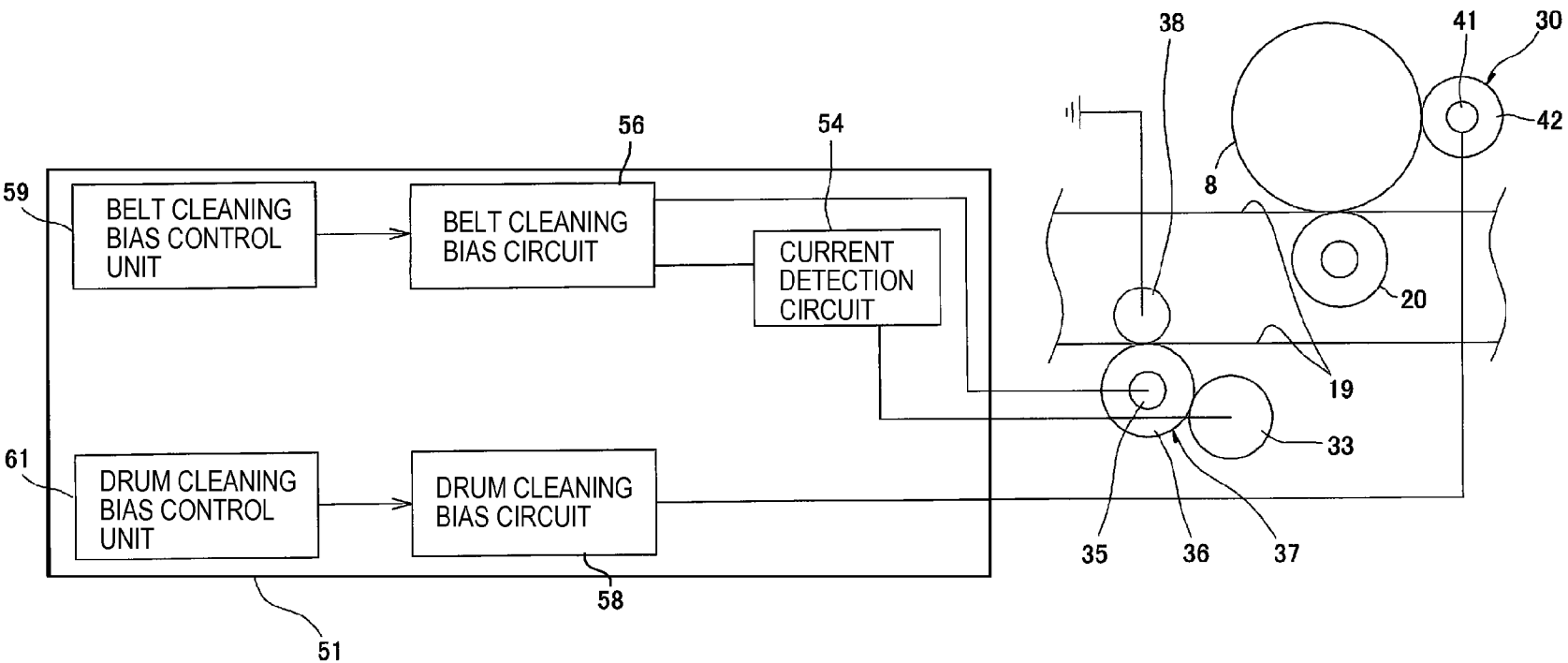
FIG. 2 is a block diagram showing main units of an electrical configuration of the printer shown in FIG. 1.

As shown in FIG. 2, the printer 1 has a microcomputer 51 that is an example of the control device.

Meanwhile, in the following descriptions, a bias that is applied to the belt cleaning roller shaft 35 is referred to as a belt cleaning bias. A bias that is applied to the collection roller 33 is referred to as a collection bias. A bias that is applied to the drum cleaning roller shaft 41 is referred to as a drum cleaning bias.

The microcomputer 51 includes a CPU, a memory and the like. The microcomputer 51 has a belt cleaning bias circuit 56, a current detection circuit 54 and a drum cleaning bias circuit 58. Further, the microcomputer 51 has a belt cleaning bias control unit 59 and a drum cleaning bias control unit 61, as configurations that are implemented in software by program processing of the CPU. The belt cleaning bias control unit 59 controls the belt cleaning bias circuit 56. The drum cleaning bias control unit 61 controls the drum cleaning bias circuit 58.

The belt cleaning bias circuit 56 is electrically connected to the belt cleaning roller shaft 35 and the collection roller 33. The belt cleaning bias circuit 56 applies a predetermined belt cleaning bias to the belt cleaning roller shaft 35 and a predetermined collection bias to the collection roller 33, based on the control of the belt cleaning bias control unit 59.

The current detection circuit 54 is electrically interposed between the belt cleaning bias circuit 56 and the collection roller 33 and measures current flowing between the belt cleaning bias circuit 56 and the collection roller 33.

The drum cleaning bias circuit 58 is electrically connected to the drum cleaning roller shaft 41. The drum cleaning bias circuit 58 applies a predetermined drum cleaning bias to the drum cleaning roller shaft 41, based on the control of the drum cleaning bias control unit 61.

4. Printing Operations of Printer

The printing operations of the printer 1 are specifically described in an example where the belt cleaning roller shaft 35 is made of stainless (SUS23), the belt roller cleaning roller body 36 is made of silicon resin and the belt cleaning roller 37 is made of EPDM (ethylene-propylene-diene rubber).

Figure 5:
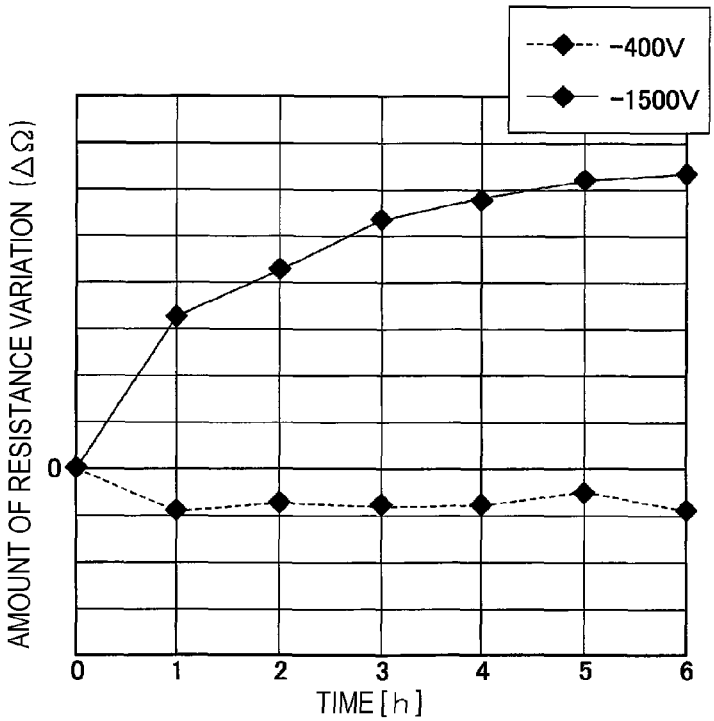
FIG. 5 is a correlation diagram showing a temporal change of an electric resistance when a negative bias is applied to a belt cleaning roller.

In the meantime, as shown in FIG. 5, when the bias of −1,500V is applied to the belt cleaning roller 37, an electric resistance of the belt cleaning roller 37 is increased with time. The bias that increases the electric resistance of the belt cleaning roller 37 with time is referred to as a first bias. Also, when the bias of −400V is applied to the belt cleaning roller 37, the electric resistance of the belt cleaning roller 37 is decreased with time. The bias that decreases the electric resistance of the belt cleaning roller 37 with time is referred to as a second bias.

Figure 6:
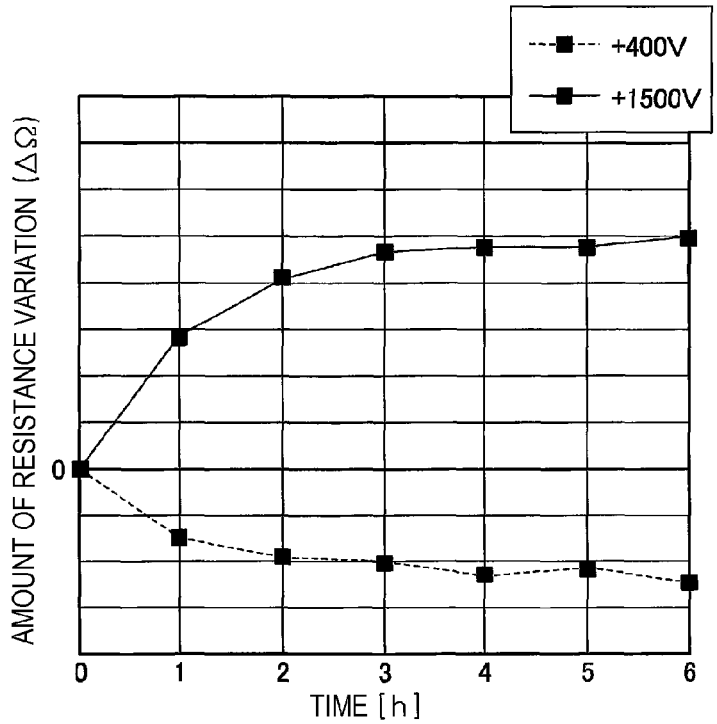
FIG. 6 is a correlation diagram showing a temporal change of the electric resistance when a positive bias is applied to the belt cleaning roller.

Also, as shown in FIG. 6, when the bias of +1,500V is applied to the belt cleaning roller 37, the electric resistance of the belt cleaning roller 37 is increased with time. That is, the bias of +1,500V is the first bias. Also, when the bias of +400V is applied to the belt cleaning roller 37, the electric resistance of the belt cleaning roller 37 is decreased with time. That is, the bias of +400V is the second bias.

(1) Preliminary Operation

Figure 3:
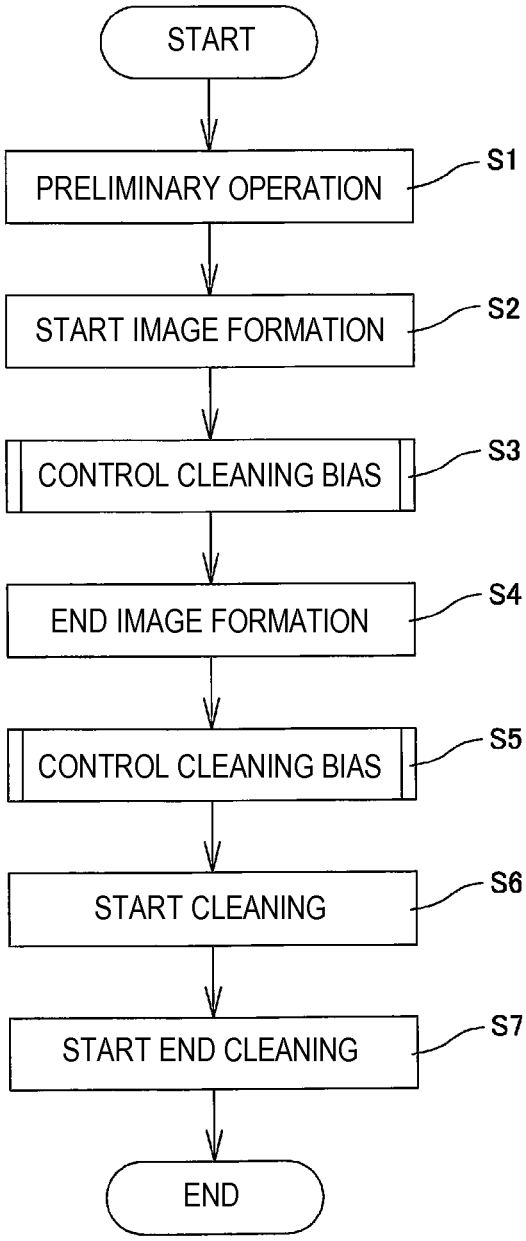
FIG. 3 is a flowchart showing an image forming operation of the printer shown in FIG. 1.

As shown in FIG. 3, when a power supply of the printer 1 becomes ON, a preliminary operation is executed before an image forming operation (S1). In the preliminary operation, the toner is preliminarily stirred in the developing cartridge 7, it is detected whether the developing cartridge 7 is mounted or not, a specification of the developing cartridge 7 is detected, and the like.

(2) Image Forming Operation

When the preliminary operation of the printer 1 is over and image data transmitted from an external PC and the like is received, the image forming operation starts (S2).

During the image forming operation, the drum cleaning bias of −300V, for example, is applied to the drum cleaning roller shaft 41 from the drum cleaning bias circuit 58.

Also, the belt cleaning bias (first bias) of −1,500V, for example, is applied to the belt cleaning roller shaft 35 from the belt cleaning bias circuit 56.

Also, the collection bias of −2,000V, for example, is applied to the collection roller 33 from the belt cleaning bias circuit 56.

Also, the opposing roller 38 is grounded to the body casing 2.

In the meantime, at the beginning of the image forming operation, the current of 10 μA flows from the belt cleaning roller shaft 35 towards the opposing roller 38.

Also, the current of 10 μA flows from the collection roller 33 towards the belt cleaning roller shaft 35. In the meantime, the current flowing from the collection roller 33 towards the belt cleaning roller shaft 35 is measured by the current detection circuit 54.

Then, the electric resistance of the belt cleaning roller 37 is calculated as $50\times10^{6}\Omega$ ($500/10\times10^{-6}$) from the current (10 μA) measured by the current detection circuit 54 and a potential difference (500V:−1,500V−(−2,000V)) between the collection roller 33 and the belt cleaning roller shaft 35.

During the image forming operation, when the sheet P passes to an opposed part between the photosensitive drum 8 and the transfer roller 20, the toner image carried on the photosensitive drum 8 is transferred to the sheet P, as described above.

At this time, toner (which is an example of the adhering substance) that has not been transferred to the sheet P may remain on the circumferential surface of the photosensitive drum 8. Also, paper dust (which is an example of the adhering substance) of the sheet P may be adhered on the surface of the conveyance belt 19.

The transfer remaining toner, which remains on the circumferential surface of the photosensitive drum 8, is opposed to the drum cleaning roller 30 as the photosensitive drum 8 is rotated. Then, the transfer remaining toner is electrostatically carried on the circumferential surface of the drum cleaning roller 30 by the drum cleaning bias.

The paper dust adhered on the surface of the conveyance belt 19 is opposed to the belt cleaning roller 37 as the conveyance belt 19 circulates. Then, the paper dust is electrostatically carried on the circumferential surface of the belt cleaning roller 37 by the belt cleaning bias.

The paper dust carried on the circumferential surface of the belt cleaning roller 37 is opposed to the collection roller 33 as the belt cleaning roller 37 is rotated, and is electrostatically carried on the circumferential surface of the collection roller 33 by the collection bias. After that, the paper dust carried on the circumferential surface of the collection roller 33 is physically scraped by the scraping blade 39. The scraped paper dust is dropped and stored into the accommodation housing 32 of the belt cleaning unit 31.

When the image forming operation continues and the belt cleaning bias (first bias) of −1,500V is thus continuously applied to the belt cleaning roller 37, the electric resistance R of the belt cleaning roller 37 is increased with time. Then, the current flowing from the belt cleaning roller shaft 35 towards the opposing roller 38 is decreased with time.

At this time, the belt cleaning bias is switched to the second bias that reduces the electric resistance R of the belt cleaning roller 37 (S3).

Figure 4:
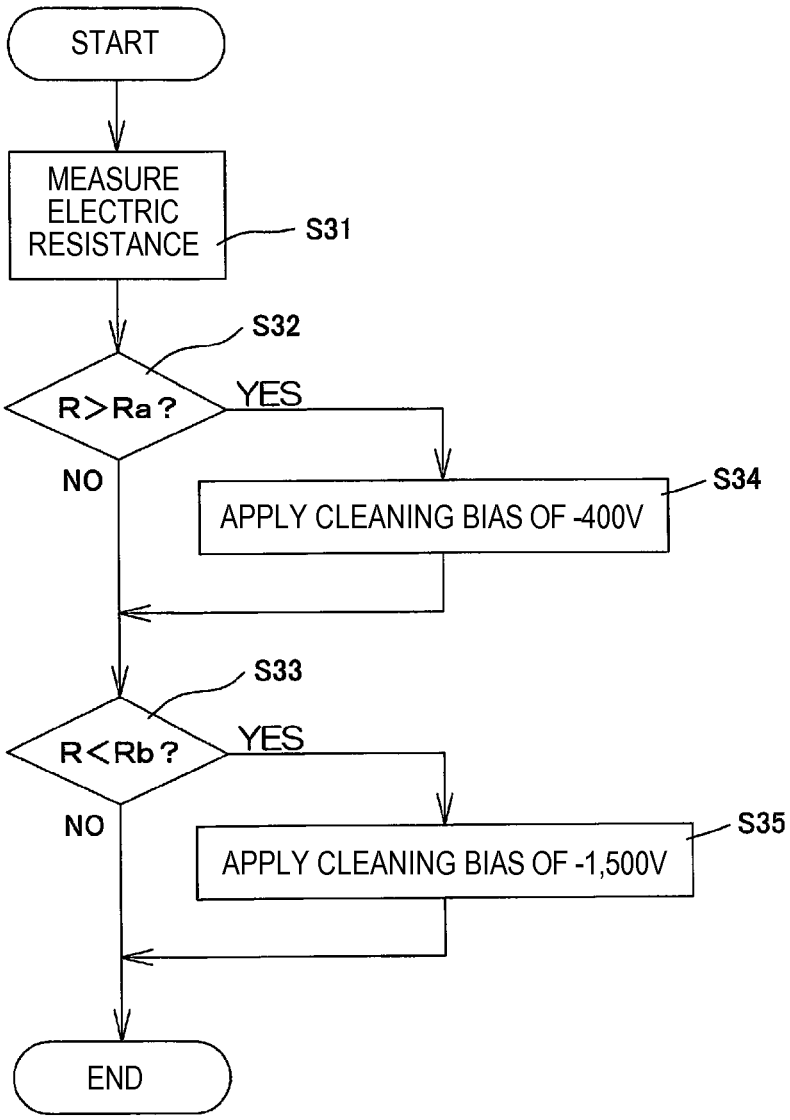
FIG. 4 is a flowchart showing a cleaning bias control step shown in FIG. 3.

As shown in FIG. 4, in order to switch the belt cleaning bias, the electric resistance R of the belt cleaning roller 37 is first measured (S31).

In order to measure the electric resistance R of the belt cleaning roller 37, the current flowing from the collection roller 33 towards the belt cleaning roller shaft 35 is first measured by the current detection circuit 54.

Then, the electric resistance R of the belt cleaning roller 37 is calculated from the current measured by the current detection circuit 54 and a potential difference between the collection roller 33 and the belt cleaning roller shaft 35.

Then, in order to switch the belt cleaning bias, the measured electric resistance R and a resistance value Ra of an upper limit (for example, $1\times10^8\Omega$), which is an example of the first threshold value, are compared (S32).

When the electric resistance R of the belt cleaning roller 37 is larger than the resistance value Ra of an upper limit (S32: YES), the bias (second bias) of −400V that decreases the electric resistance R with time, for example, is applied to the belt cleaning roller 37 (S34).

At this time, the collection bias is also switched together with the cleaning bias. Specifically, while an absolute value of the cleaning bias is reduced, an absolute value of the collection bias is also reduced. At this time, the collection bias is switched so that a potential difference between the cleaning bias and the collection bias is kept constant. Specifically, the bias of −900V is applied to the collection roller 33.

Thereby, the electric resistance R of the belt cleaning roller 37 is decreased with time and the current flowing from the belt cleaning roller shaft 35 towards the opposing roller 38 is increased with time.

On the other hand, when the electric resistance R of the belt cleaning roller body 36 is smaller than the resistance value Ra of an upper limit (S32: NO), the belt cleaning bias is not switched.

Also, when the image forming operation further continues and the belt cleaning bias (second bias) of −400V is thus continuously applied to the belt cleaning roller 37 after the belt cleaning bias is switched, the electric resistance R of the belt cleaning roller 37 is decreased with time. Then, the current flowing from the belt cleaning roller shaft 35 towards the opposing roller 38 is increased with time.

At this time, the belt cleaning bias is switched to the first bias that increases the electric resistance R of the belt cleaning roller 37 (S3).

In order to switch the belt cleaning bias, the measured electric resistance R and a resistance value Rb of a lower limit (for example, $1\times10^6\Omega$), which is an example of the second threshold value, are compared (S33).

When the electric resistance R of the belt cleaning roller 37 is smaller than the resistance value Rb of a lower limit (S33: YES), the bias (first bias) of −1,500V that increases the electric resistance R with time, for example, is applied to the belt cleaning roller 37 (S35).

At this time, the collection bias is also switched together with the cleaning bias. Specifically, while an absolute value of the cleaning bias is increased, an absolute value of the collection bias is also increased. At this time, the collection bias is switched so that the potential difference between the cleaning bias and the collection bias is kept constant. Specifically, the bias of −2,000V is applied to the collection roller 33.

Thereby, the electric resistance R of the belt cleaning roller 37 is increased with time and the current flowing from the belt cleaning roller shaft 35 towards the opposing roller 38 is decreased with time.

On the other hand, when the electric resistance R of the belt cleaning roller 37 is larger than the resistance value Rb of a lower limit (S33: NO), the belt cleaning bias is not switched.

By doing so, the belt cleaning bias is controlled so that the electric resistance R of the belt cleaning roller 37 is converged within a predetermined range, based on the detection of the current detection circuit 54.

Thereby, the current flowing from the belt cleaning roller shaft 35 towards the opposing roller 38 is adjusted within a predetermined range.

(4) Collection Operation of Transfer Remaining Toner from Drum Cleaning Roller In the printer 1, when the image forming operation is over (S4), the same cleaning bias switching control (S5) as the cleaning bias switching control (S3) is executed and then a cleaning operation (which is an example of the cleaning operation) of collecting the transfer remaining toner carried on the drum cleaning roller 30 to the belt cleaning unit 31 starts (S6).

At this time, the drum cleaning bias of 600V, for example, is applied to the drum cleaning roller shaft 41 from the drum cleaning bias circuit 58.

Upon the cleaning operation, the transfer remaining toner carried on the drum cleaning roller 30 is first discharged onto the circumferential surface of the photosensitive drum 8 by the drum cleaning bias.

The transfer remaining toner discharged onto the circumferential surface of the photosensitive drum 8 is opposed to the conveyance belt 19 as the photosensitive drum 8 is rotated.

Then, the transfer remaining toner on the surface of the photosensitive drum 8 is transferred onto the surface of the conveyance belt 19 by the transfer bias of the transfer roller 20.

After that, the transfer remaining toner (which is an example of the adhering substance) transferred onto the surface of the conveyance belt 19 is opposed to the belt cleaning belt 37 as the conveyance belt 19 circulates.

Then, like the paper dust, the transfer remaining toner is electrostatically carried on the circumferential surface of the belt cleaning roller 37 by the belt cleaning bias, is electrostatically transferred to the collection roller 33, is scraped by the scraping blade 39 and is then stored in the accommodation housing 32 of the belt cleaning unit 31.

By doing so, the cleaning operation is completed (S7).

5. Effects (1) According to the printer, as shown in FIG. 4, the microcomputer 51 controls the belt cleaning bias so that the electric resistance R of the belt cleaning roller 37 is converged within the predetermined range (for example, $1\times10^6$ to $1\times10^8\Omega$).

Therefore, the belt cleaning bias can be applied to the belt cleaning roller 37 having the electric resistance R adjusted within the predetermined range, so that it is possible to control the current flowing from the belt cleaning roller shaft 35 towards the opposing roller 38 constant.

As a result, it is possible to use the belt cleaning unit 31 for a long time while suppressing the increase in cost.

(2) Also, according to the printer 1, as shown in FIG. 4, when the electric resistance R of the belt cleaning roller 37 is increased and thus exceeds the resistance value Ra of an upper limit ($1\times10^8\Omega$), the absolute value of the belt cleaning bias is decreased to reduce the electric resistance R of the belt cleaning roller 37.

Therefore, when the electric resistance R of the belt cleaning roller 37 is increased, it is possible to reduce the electric resistance R of the belt cleaning roller 37. As a result, it is possible to use the belt cleaning unit 31 for a long time while suppressing the increase in cost.

(3) Also, according to the printer 1, as shown in FIG. 4, when the electric resistance R of the belt cleaning roller 37 is decreased and is thus below the resistance value of a lower limit Ra ($1\times10^6\Omega$), the absolute value of the belt cleaning bias is increased to increase the electric resistance R of the belt cleaning roller 37.

Therefore, when the electric resistance R of the belt cleaning roller 37 is decreased, it is possible to increase the electric resistance R of the belt cleaning roller 37. As a result, it is possible to use the belt cleaning unit 31 for a long time while suppressing the increase in cost.

(4) Also, according to the printer 1, it is possible to securely adjust the current flowing from the belt cleaning roller shaft 35 towards the opposing roller 38 within the predetermined range.

Accordingly, it is possible to reliably suppress the cleaning performance of the belt cleaning roller 37 from being lowered, so that it is possible to collect the paper dust or transfer remaining toner adhered on the conveyance belt 19 more effectively.

(5) Also, according to the printer 1, it is possible to switch the collection bias, depending on the belt cleaning bias.

Therefore, even when the belt cleaning bias is varied, it is possible to securely remove the paper dust or transfer remaining toner from the belt cleaning roller 37 by the collection roller 33.

(6) Also, according to the printer 1, as shown in FIG. 3, it is possible to control the belt cleaning bias during the image forming operation.

Hence, it is possible to effectively collect the paper dust or transfer remaining toner adhered on the conveyance belt 19 conveying the sheet P.

6. Modified Embodiments

(1) First Modified Embodiment

In the above-described illustrative embodiment, the electric resistance R of the belt cleaning roller 37 is calculated from the current measured by the current detection circuit 54 and the potential difference between the collection roller 33 and the belt cleaning roller shaft 35.

The belt cleaning bias is controlled so that the electric resistance R of the belt cleaning roller 37 is converged within the predetermined range.

However, the belt cleaning bias may be controlled without calculating the electric resistance R of the belt cleaning roller 37, for example by storing a current value Ia of a lower limit corresponding to the resistance value Ra of an upper limit and a current value Ib of an upper limit corresponding to the resistance value Rb of a lower limit in the memory of the microcomputer 51 and comparing the current value Ia of a lower limit and current value Ib of an upper limit with current flowing from the collection roller 33 towards the belt cleaning roller shaft 35.

Specifically, when the current flowing from the collection roller 33 towards the belt cleaning roller shaft 35 is below the current value Ia of a lower limit, the belt cleaning bias is switched so that the electric resistance R of the belt cleaning roller 37 is decreased, and when the current flowing from the collection roller 33 towards the belt cleaning roller shaft 35 exceeds the current value Ib of an upper limit, the belt cleaning bias is switched so that the electric resistance R of the belt cleaning roller 37 is increased.

Also in the first modified embodiment, it is possible to obtain the same operational effects as the above-described illustrative embodiment.

(2) Second Modified Embodiment

In the above-described illustrative embodiment, the resistance value Ra of an upper limit and the resistance value Rb of a lower limit are set, and the resistance value Ra of an upper limit and the resistance value Rb of a lower limit are compared with the electric resistance R of the belt cleaning roller 37 to thereby control the belt cleaning bias so that the electric resistance R of the belt cleaning roller 37 is converged between the resistance value Ra of an upper limit and the resistance value Rb of a lower limit.

However, either of the resistance value Ra of an upper limit and the resistance value Rb of a lower limit may be set, and the resistance value Ra of an upper limit or the resistance value Rb of a lower limit, which has been set, may be compared with the electric resistance R of the belt cleaning roller 37 to thus control the belt cleaning bias.

Specifically, when the resistance value Ra of an upper limit is set, the belt cleaning bias (first bias) of −1,500V that increases the electric resistance R with time is generally applied to the belt cleaning roller 37, and when the electric resistance R of the belt cleaning roller 37 exceeds the resistance value Ra of an upper limit, the belt cleaning bias (second bias) of −400V that decreases the electric resistance R with time is applied to the belt cleaning roller 37.

Also, when the resistance value Rb of a lower limit is set, the belt cleaning bias (second bias) of −400V that decreases the electric resistance R with time is generally applied to the belt cleaning roller 37, and when the electric resistance R of the belt cleaning roller 37 is below the resistance value Ra of an upper limit, the belt cleaning bias (first bias) of −1,500V that increases the electric resistance R with time is applied to the belt cleaning roller 37.

Also in the second modified embodiment, it is possible to obtain the same operational effects as the above-described illustrative embodiment.

(3) Third Modified Embodiment

In the above-described illustrative embodiment, when the electric resistance R of the belt cleaning roller 37 exceeds the resistance value Ra of an upper limit, the bias that decreases the electric resistance R with time is applied to the belt cleaning roller 37.

Figure 7:
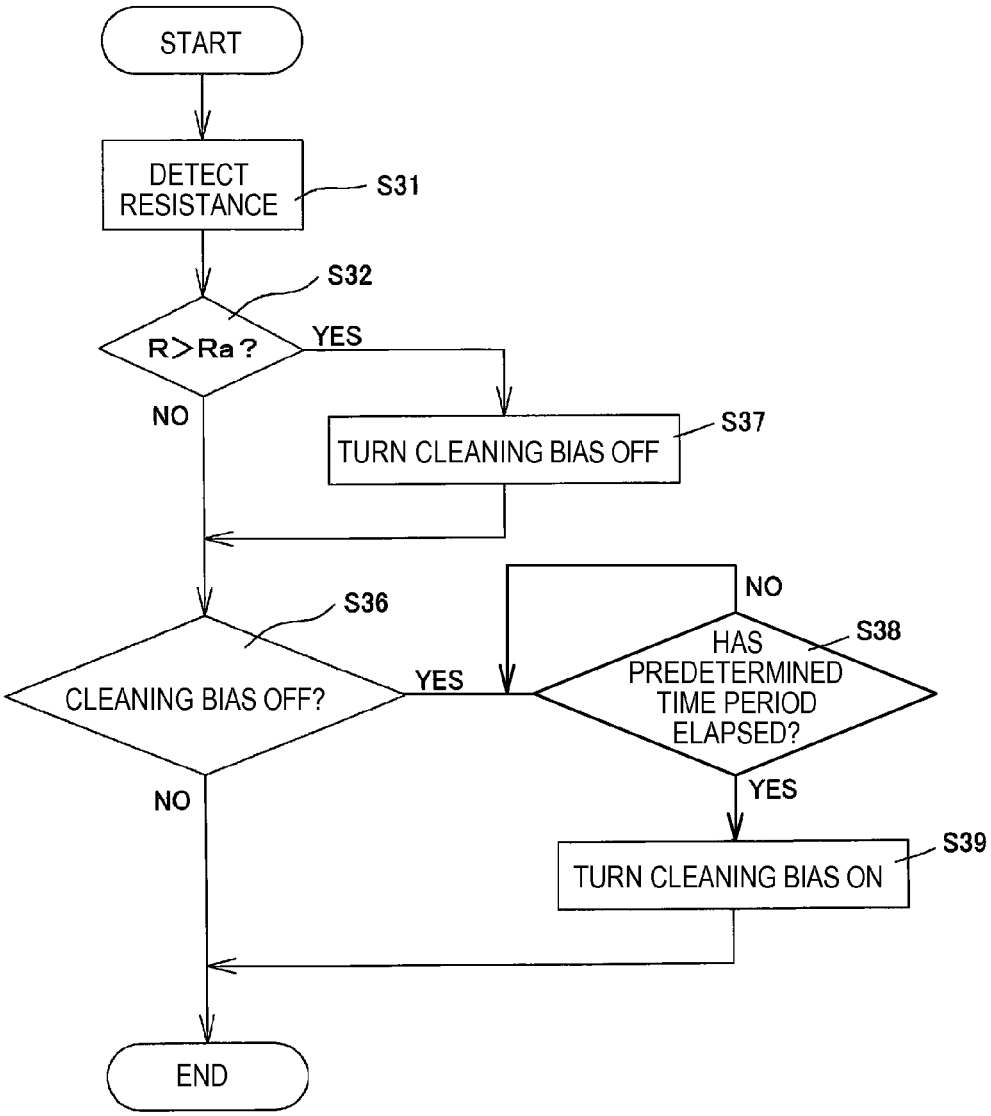
FIG. 7 is a flowchart showing a modified embodiment of the cleaning bias control step shown in FIG. 3.

However, as shown in FIG. 7, when the electric resistance R of the belt cleaning roller 37 exceeds the resistance value Ra of an upper limit (S32: YES), the applying of the belt cleaning bias may be interrupted (S37).

In this case, it is determined whether the applying of the belt cleaning bias is interrupted (S36). When the applying is interrupted (S36: YES), the applying of the belt cleaning bias is resumed (S39) after a predetermined time period elapses (S38: YES).

According to the third modified embodiment, it is possible to reduce the electric resistance R of the belt cleaning roller 37 with a simple method of interrupting the applying of the belt cleaning bias to the belt cleaning roller 37.

Also in the third modified embodiment, it is possible to obtain the same operational effects as the above-described illustrative embodiment.

(4) Fourth Modified Embodiment

In the above-described illustrative embodiment, although the belt cleaning bias is controlled based on the electric resistance R of the belt cleaning roller 37, a constant drum cleaning bias is applied to the drum cleaning roller 30.

However, the drum cleaning bias that is applied to the drum cleaning roller 30 may be controlled in the same manner as the belt cleaning bias of the above-described illustrative embodiment. In this case, the drum cleaning roller 30 becomes an example of the collection member and the drum cleaning bias circuit 58 applies bias to the drum cleaning roller.

Further, the operation of collecting the adhering substance adhered on the photosensitive drum 8 by the drum cleaning roller 30 becomes an example of the cleaning operation. Meanwhile, in the fourth modified embodiment, the drum cleaning bias is not controlled during the image forming operation (refer to S3 in FIG. 3). That is, the drum cleaning bias is controlled so that the electric resistance R of the drum cleaning roller 30 is converged within the predetermined range, before the image formation.

According to the fourth modified embodiment, the microcomputer 51 controls the drum cleaning bias so that the electric resistance of the drum cleaning roller 30 is converged within the predetermined range.

Therefore, the bias can be applied to the drum cleaning roller 30 having the electric resistance adjusted within the predetermined range, so that it is possible to control the current flowing to the drum cleaning roller 30 constant.

As a result, it is possible to suppress the cleaning performance of the drum cleaning roller 30 from being lowered and to effectively collect the transfer remaining toner adhered on the photosensitive drum 8.

(5) Fifth Modified Embodiment

In the fourth modified embodiment, it is also possible to collect the adhering substance carried on the drum cleaning roller 30 into the developing cartridge 7 (so-called cleanerless type).

In this case, the transfer remaining toner carried on the drum cleaning roller 30 is discharged onto the circumferential surface of the photosensitive drum 8, as described above, is opposed to the developing roller 11 as the photosensitive drum 8 is rotated and is then collected into the developing cartridge 7 through the developing roller 11.

Also in the fifth modified embodiment, it is possible to obtain the same operational effects as the fourth modified embodiment.

(6) Other Modified Embodiments

In the above-described illustrative embodiment, the cleaning bias is controlled both during the image forming operation (refer to S3 in FIG. 3) and between the image forming operation and the cleaning operation (refer to S5 in FIG. 3). However, the cleaning bias may be controlled only during either of them, for example, only between the image forming operation and the cleaning operation.

Also in this case, it is possible to obtain the same operational effects as the above-described illustrative embodiment.

What is claimed is:

1. An image forming apparatus comprising:

an image carrier on which an electrostatic latent image is configured to be formed;

a holding member that contacts the image carrier and is configured to carry adhering substance received from the image carrier;

a belt that contacts the image carrier;

a collection member that contacts the belt and is configured to collect adhering substance adhered on the belt; and a control device configured to:

apply a bias to the collection member, detect an electric resistance of the collection member, converge the electric resistance of the collection member to within a predetermined range by controlling the bias that is applied to the collection member based on the detected electric resistance of the collection member, when a cleaning operation of collecting the adhering substance adhered on the holding member from the holding member to the collection member is not performed, and decrease an absolute value of the bias that is applied to the collection member by controlling the bias that is applied to the collection member when the detected electric resistance of the collection member is larger than a first threshold value.

2. The image forming apparatus according to claim 1,
wherein the control device is further configured to interrupt application of the bias to the collection member when decreasing the absolute value of the bias that is applied to the collection member.

3. The image forming apparatus according to claim 1,
wherein the control device is further configured to increase the absolute value of the bias that is applied to the collection member when the detected electric resistance of the collection member is smaller than a second threshold value smaller than the first threshold value.

4. The image forming apparatus according to claim 1,
wherein the control device is further configured to adjust current flowing through the collection member within a predetermined range by controlling the bias applied to the collection member.

5. The image forming apparatus according to claim 1, further comprising a removal member that contacts the collection member and is configured to remove the adhering substance collected by the collection member from the collection member,
wherein the control device is further configured to:
apply a bias to the removal member so that the adhering substance collected by the collection member is collected by the removal member, and
control the bias that is applied to the removal member together with the bias that is applied to the collection member.

6. The image forming apparatus according to claim 1,
wherein the belt is configured to convey a transferred member on which a developer image, which is formed by developing the electrostatic latent image, is transferred, in a state where the transferred member contacts with the image carrier, and
wherein the control device is further configured to apply the bias to the collection member during a transfer operation of transferring the developer image from the image carrier to the transferred member.

7. The image forming apparatus according to claim 1,
wherein the control device is further configured to control the bias that is applied to the collection member by comparing the detected electric resistance of the collection member with a predetermined threshold value.

8. The image forming apparatus according to claim 7, further comprising a memory unit,
wherein the predetermined threshold value is stored in the memory unit, and
wherein the control device is further configured to obtain the predetermined threshold value from the memory unit when comparing the detected electric resistance of the collection member with the predetermined threshold value.

9. An image forming apparatus comprising:
an image carrier on which an electrostatic latent image is configured to be formed;
a collection member that contacts the image carrier and is configured to collect adhering substance adhered on the image carrier; and
a control device configured to:
apply a bias to the collection member,
detect an electric resistance of the collection member,
converge the electric resistance of the collection member to within a predetermined range by controlling the bias that is applied to the collection member based on the detected electric resistance of the collection member, when a cleaning operation of collecting the adhering substance adhered on the image carrier to the collection member is not performed, and
decrease an absolute value of the bias that is applied to the collection member by controlling the bias that is applied to the collection member when the detected electric resistance of the collection member is larger than a first threshold value.

10. The image forming apparatus according to claim 9,
wherein the control device is further configured to interrupt application of the bias to the collection member when decreasing the absolute value of the bias that is applied to the collection member.

11. The image forming apparatus according to claim 9,
wherein the control device is further configured to increase the absolute value of the bias that is applied to the collection member when the detected electric resistance of the collection member is smaller than a second threshold value smaller than the first threshold value.

12. The image forming apparatus according to claim 9,
wherein the control device is further configured to adjust current flowing through the collection member within a predetermined range by controlling the bias applied to the collection member.

13. The image forming apparatus according to claim 9,
wherein the control device is further configured to control the bias that is applied to the collection member by comparing the detected electric resistance of the collection member with a predetermined threshold value.

14. The image forming apparatus according to claim 13, further comprising a memory unit,
wherein the predetermined threshold value is stored in the memory unit, and
wherein the control device is further configured to obtain the predetermined threshold value from the memory unit when comparing the detected electric resistance of the collection member with the predetermined threshold value.

* * * * *